US011001474B2

(12) United States Patent
Gurvich et al.

(10) Patent No.: US 11,001,474 B2
(45) Date of Patent: May 11, 2021

(54) WEAR DETECTION OF ELEVATOR BELT

(71) Applicant: Otis Elevator Company, Farmington, CT (US)

(72) Inventors: Mark R. Gurvich, Middletown, CT (US); Georgios S. Zafiris, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 659 days.

(21) Appl. No.: 15/871,625

(22) Filed: Jan. 15, 2018

(65) Prior Publication Data

US 2019/0218063 A1 Jul. 18, 2019

(51) Int. Cl.

| | |
|---|---|
| ***B66B 7/12*** | (2006.01) |
| ***D07B 1/14*** | (2006.01) |
| ***B66B 11/00*** | (2006.01) |
| ***D07B 1/16*** | (2006.01) |
| ***B66B 7/06*** | (2006.01) |
| *D07B 1/22* | (2006.01) |
| *B66B 5/00* | (2006.01) |

(52) U.S. Cl.

CPC ..... *B66B 7/1238* (2013.01); *B66B 7/062* (2013.01); *B66B 11/008* (2013.01); *D07B 1/145* (2013.01); *D07B 1/148* (2013.01); *D07B 1/16* (2013.01); *B66B 5/0018* (2013.01); *D07B 1/22* (2013.01); *D07B 2201/2094* (2013.01); *D07B 2501/2007* (2013.01)

(58) Field of Classification Search

CPC ..... B66B 7/1238; B66B 7/064; B66B 7/062
USPC ..... 187/393
See application file for complete search history.

(56) References Cited

U.S. PATENT DOCUMENTS

| | | | | |
|---|---|---|---|---|
| 4,887,155 | A * | 12/1989 | Massen | D01G 31/006 348/88 |
| 5,804,964 | A * | 9/1998 | Hamelin | G01N 27/82 324/227 |
| 6,886,666 | B2 | 5/2005 | Stucky et al. | |
| 7,137,483 | B2 | 11/2006 | Kato et al. | |
| 7,401,961 | B2 | 7/2008 | Longatti et al. | |
| 7,475,926 | B2 | 1/2009 | Summars | |
| 8,025,144 | B2 | 9/2011 | Lewis et al. | |
| 8,254,660 | B2 * | 8/2012 | Verreet | B66B 7/1238 382/141 |

(Continued)

FOREIGN PATENT DOCUMENTS

| | | |
|---|---|---|
| CN | 101372814 A | 2/2009 |
| CN | 105755879 A | 7/2016 |

(Continued)

OTHER PUBLICATIONS

Extended European Search Report for Application No. 19151834.9; dated Jun. 21, 2019, 16 pages.

*Primary Examiner* — David S Warren
(74) *Attorney, Agent, or Firm* — Cantor Colburn LLP

(57) ABSTRACT

A belt includes one or more tension members extending along a length of the belt, a jacket at least partially enclosing the plurality of tension members, and one or more layers of one or more of a fluorescent, absorbing, or reflecting material located in the belt such that when subjected to a light source, an indication of fluorescence or absorbance or reflection of the one or more layers of fluorescent or absorbent or reflective materials is indicative of a wear condition of the belt.

20 Claims, 13 Drawing Sheets

(56) References Cited

U.S. PATENT DOCUMENTS 8,526,706 B2 * 9/2013 Verreet ..... G01N 21/8803 382/141
9,365,395 B2 6/2016 Fargo et al.
9,944,494 B2 * 4/2018 Alasentie ..... D07B 1/025
10,053,331 B2 * 8/2018 Kere ..... D07B 1/148
10,737,906 B2 * 8/2020 Dudde ..... B66B 7/062
2003/0011483 A1 * 1/2003 Lamb ..... D07B 1/145 340/664
2004/0098963 A1 5/2004 Calleeuw et al.
2007/0278047 A1 * 12/2007 Ach ..... B66B 11/009 187/264
2009/0232383 A1 * 9/2009 Verreet ..... G01N 21/8803 382/141
2011/0089130 A1 4/2011 Stephan
2011/0259677 A1 * 10/2011 Dudde ..... D07B 1/145 187/411
2012/0294506 A1 * 11/2012 Verreet ..... G01N 21/8803 382/141
2013/0206516 A1 * 8/2013 Pelto-Huikko ..... B66B 9/00 187/254
2014/0182974 A1 * 7/2014 Puranen ..... B66B 5/0018 187/247
2014/0299419 A1 10/2014 Pelto-Huikko et al.
2014/0305744 A1 * 10/2014 Kere ..... B66B 7/06 187/254
2014/0345978 A1 * 11/2014 Alasentie ..... D07B 1/02 187/254
2015/0060211 A1 3/2015 Chou
2015/0191332 A1 7/2015 Kere
2015/0197408 A1 7/2015 St. Germain et al.
2015/0362450 A1 * 12/2015 Lehtinen ..... G01N 27/20 187/391
2017/0349405 A1 * 12/2017 Ammon ..... B66B 5/0006
2019/0218063 A1 * 7/2019 Gurvich ..... D07B 1/145
2019/0256324 A1 * 8/2019 Antin ..... B66B 7/1223
2019/0322489 A1 * 10/2019 Watabe ..... B66B 5/02
2020/0071130 A1 * 3/2020 Kato ..... B66B 3/00
2020/0122975 A1 * 4/2020 Wei ..... B66B 7/1238

FOREIGN PATENT DOCUMENTS

DE 2013008854 U1 1/2015
EP 1312574 A1 5/2003
EP 3205616 A1 8/2017
JP 2004075221 A * 3/2004 ..... B66B 7/1238

* cited by examiner

WEAR DETECTION OF ELEVATOR BELT

BACKGROUND

Embodiments disclosed herein relate to elevator systems, and more particularly to load bearing members to suspend and/or drive elevator cars of an elevator system.

Elevator systems are useful for carrying passengers, cargo, or both, between various levels in a building. Some elevators are traction based and utilize load bearing members such as belts for supporting the elevator car and achieving the desired movement and positioning of the elevator car.

Referring to FIG. 14, where a belt is used as a load bearing member, a plurality of tension members 104 are embedded in a common jacket 102. The jacket 102 retains the tension members 104 in desired positions and provides a frictional load path. In an exemplary traction elevator system, a machine drives a traction sheave 108 with which the belts interact to drive the elevator car along a hoistway. Belts typically utilize tension members formed from steel elements, but alternatively may utilize tension members formed from synthetic or natural fibers or other materials, such as carbon fiber reinforced composites.

Due to numerous factors, such as long-term service, curvature of sheave 108, multiple belts with tension non-uniformity, variability in fabrication and installation, wear 106 is observed, such as shown for example of non-uniform pattern in FIG. 14. Wear increases with duration of service, and eventually can result in the tension member being exposed to or contacting the environment, or the remaining jacket layer too thin to meet requirements for durability, traction, tracking, noise, or the like. Reliable solutions to monitor actual wear of the belt can help mitigate premature belt replacement or avoid risky belt service life extension, while reducing the cost of belt maintenance and inspection.

BRIEF DESCRIPTION

In one embodiments, a belt includes one or more tension members extending along a length of the belt, a jacket at least partially enclosing the plurality of tension members, and one or more layers of one or more of a fluorescent, absorbing, or reflecting material located in the belt such that when subjected to a light source, an indication of fluorescence or absorbance or reflection of the one or more layers of fluorescent or absorbent or reflective materials is indicative of a wear condition of the belt.

Additionally or alternatively, in this or other embodiments the one or more layers of fluorescent or absorbent or reflective material are located at an outer surface of the jacket.

Additionally or alternatively, in this or other embodiments the one or more layers of fluorescent or absorbent or reflective material are located in an interior of the jacket, between the jacket outer surface and the one or more tension members.

Additionally or alternatively, in this or other embodiments the one or more layers of fluorescent or absorbent or reflective material are located at only one of a traction side or a back side of the belt.

Additionally or alternatively, in this or other embodiments the one or more layers of fluorescent or absorbent or reflective material are located asymmetrically with respect to a belt thickness direction.

Additionally or alternatively, in this or other embodiments the one or more layers of fluorescent or absorbent or reflective material are located one of continuously or discontinuously along a length or a width of the belt.

Additionally or alternatively, in this or other embodiments the one or more tension members are a plurality of tension members arrayed across a belt width, each tension member including a plurality of wires.

Additionally or alternatively, in this or other embodiments the one or more tension members comprises a plurality of fibers suspended in a polymer matrix material.

Additionally or alternatively, in this or other embodiments the polymer matrix material includes one or more fluorescent or absorbent or reflective materials.

Additionally or alternatively, in this or other embodiments the light source is an ultraviolet light or visible or other light spectrum source.

In another embodiment, a method of wear detection of a belt includes emitting light from a light emitter toward a belt of an elevator system, one or more of fluorescing, absorbing, or reflecting one or more materials of the elevator belt, and detecting a pattern of the fluorescence, absorbance or reflectance of the elevator belt. The pattern of fluorescence or absorbance or reflectance is indicative of a wear pattern of the belt.

Additionally or alternatively, in this or other embodiments the light source is an ultraviolet (UV) light or visible light or other light spectrum source.

Additionally or alternatively, in this or other embodiments the detecting the pattern of fluorescence, absorbance, or reflectance is accomplished via a detector.

Additionally or alternatively, in this or other embodiments the method includes detecting the pattern of fluorescence, absorbance, or reflectance at both a traction side and a back side of the belt.

In yet another embodiment, an elevator system includes a hoistway, an elevator car located in the hoistway, and an elevator belt operably connected to the elevator car to suspend and/or drive the elevator car along the hoistway. The elevator belt includes one or more tension members extending along a length of the belt, a jacket at least partially enclosing the plurality of tension members, and one or more layers of fluorescent, or absorbent or reflective materials located in the at least one belt. A wear detection system is located in the hoistway including a light emitter to direct light at the elevator belt, and a detector configured to detect a pattern of the fluorescence, absorbance, or reflectance of the elevator belt, wherein the pattern of fluorescence, absorbance, or reflectance is indicative of a wear pattern of the belt.

Additionally or alternatively, in this or other embodiments the emitter is configured to emit ultraviolet (UV) or visible or other light spectrum.

Additionally or alternatively, in this or other embodiments the detector is unitary with the emitter.

Additionally or alternatively, in this or other embodiments the one or more layers of fluorescent, or absorbent or reflective material are located at an outer surface of the jacket.

Additionally or alternatively, in this or other embodiments the one or more layers of fluorescent, or absorbent or reflective material are located in an interior of the jacket, between the jacket outer surface and the one or more tension members.

Additionally or alternatively, in this or other embodiments the one or more tension members comprises a plurality of fibers suspended in a polymer matrix material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
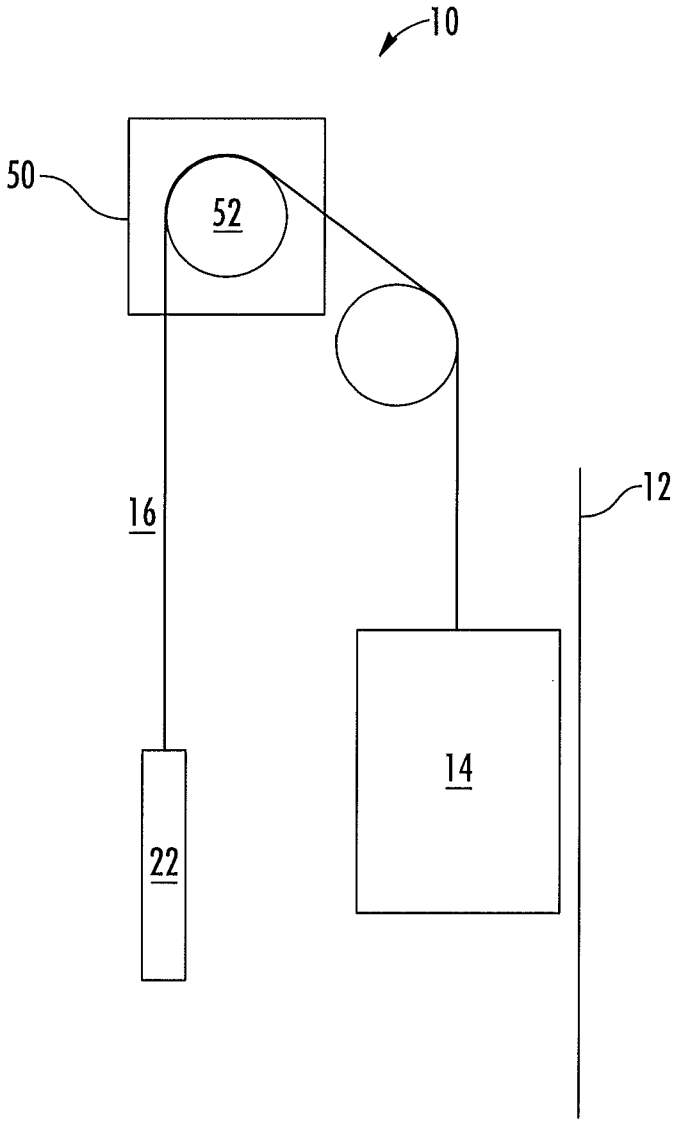
FIG. 1 is a schematic illustration of an embodiment of a representative elevator system.

Shown in FIG. 1 is a schematic view of an exemplary traction elevator system 10. Features of the elevator system 10 that are not required for an understanding of the present invention (such as the guide rails, safeties, etc.) are not discussed herein. The elevator system 10 includes an elevator car 14 operatively suspended or supported in a hoistway 12 with one or more belts 16. The one or more belts 16 interact with sheaves 18 and 52 to be routed around various components of the elevator system 10. Sheave 18 is configured as a diverter, deflector or idler sheave and sheave 52 is configured as a traction sheave, driven by a machine 50. Movement of the traction sheave 52 by the machine 50 drives, moves and/or propels (through traction) the one or more belts 16 that are routed around the traction sheave 52. Diverter, deflector or idler sheaves 18 are not driven by a machine 50, but help guide the one or more belts 16 around the various components of the elevator system 10. The one or more belts 16 could also be connected to a counterweight 22, which is used to help balance the elevator system 10 and reduce the difference in belt tension on both sides of the traction sheave during operation. The sheaves 18 and 52 each have a diameter, which may be the same or different from each other.

In some embodiments, the elevator system 10 could use two or more belts 16 for suspending and/or driving the elevator car 14 In addition, the elevator system 10 could have various configurations such that either both sides of the one or more belts 16 engage the sheaves 18, 52 or only one side of the one or more belts 16 engages the sheaves 18, 52. The embodiment of FIG. 1 shows a 1:1 roping arrangement in which the one or more belts 16 terminate at the car 14 and counterweight 22, while other embodiments may utilize other roping arrangements.

The belts 16 are constructed to meet belt life requirements and have smooth operation, while being sufficiently strong to be capable of meeting strength requirements for suspending and/or driving the elevator car 14 and counterweight 22.

Figure 2:
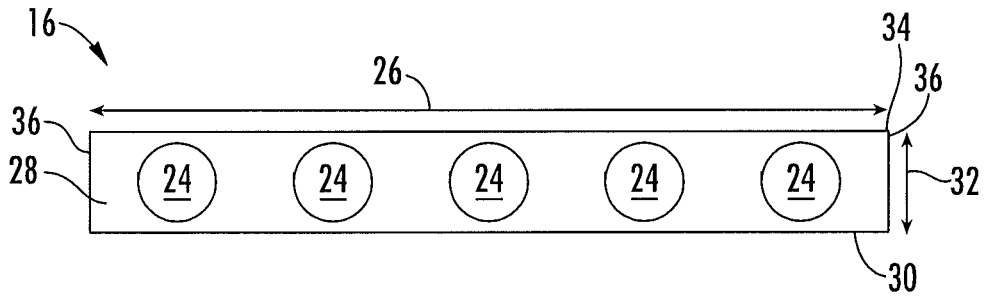
FIG. 2 is cross-sectional view of an embodiment of a belt.

FIG. 2 provides a cross-sectional schematic of an exemplary belt 16 construction or design. The belt 16 includes a plurality of tension members 24 extending longitudinally along the belt 16 and arranged across a belt width 26. The tension members 24 are at least partially enclosed in a jacket material 28 to restrain movement of the tension members 24 in the belt 16 with respect to each other and to protect the tension members 24. The jacket material 28 defines a traction side 30 configured to interact with a corresponding surface of the traction sheave 52. Exemplary materials for the jacket material 28 include the elastomers of thermoplastic and thermosetting polyurethanes, thermoplastic polyester elastomers, ethylene propylene diene elastomer, chloroprene, chlorosulfonyl polyethylene, ethylene vinyl acetate, polyamide, polypropylene, butyl rubber, acrylonitrile butadiene rubber, styrene butadiene rubber, acrylic elastomer, fluoroelastomer, silicone elastomer, polyolefin elastomer, styrene block and diene elastomer, natural rubber, or combinations thereof. Other materials may be used to form the jacket material 28 if they are adequate to meet the required functions of the belt 16. For example, a primary function of the jacket material 28 is to provide a sufficient coefficient of friction between the belt 16 and the traction sheave 52 to produce a desired amount of traction therebetween. The jacket material 28 should also transmit the traction loads to the tension members 24. In addition, the jacket material 28 should be wear resistant and protect the tension members 24 from impact damage, exposure to environmental factors, such as chemicals, for example.

The belt 16 has a belt width 26 and a belt thickness 32, with an aspect ratio of belt width 26 to belt thickness 32 greater than one. The belt 16 further includes a back side 34 opposite the traction side 30 and belt edges 36 extending between the traction side 30 and the back side 34. While five tension members 24 are illustrated in the embodiment of FIG. 2, other embodiments may include other numbers of tension members 24, for example, 6, 10 or 12 tension members 24. Further, while the tension members 24 of the embodiment of FIG. 2 are substantially identical, in other embodiments, the tension members 24 may differ from one another. While a belt 16 with a rectangular cross-section is illustrated in FIG. 2, it is to be appreciated that belts 16 having other cross-sectional shapes are contemplated within the scope of the present disclosure.

Figure 3A:
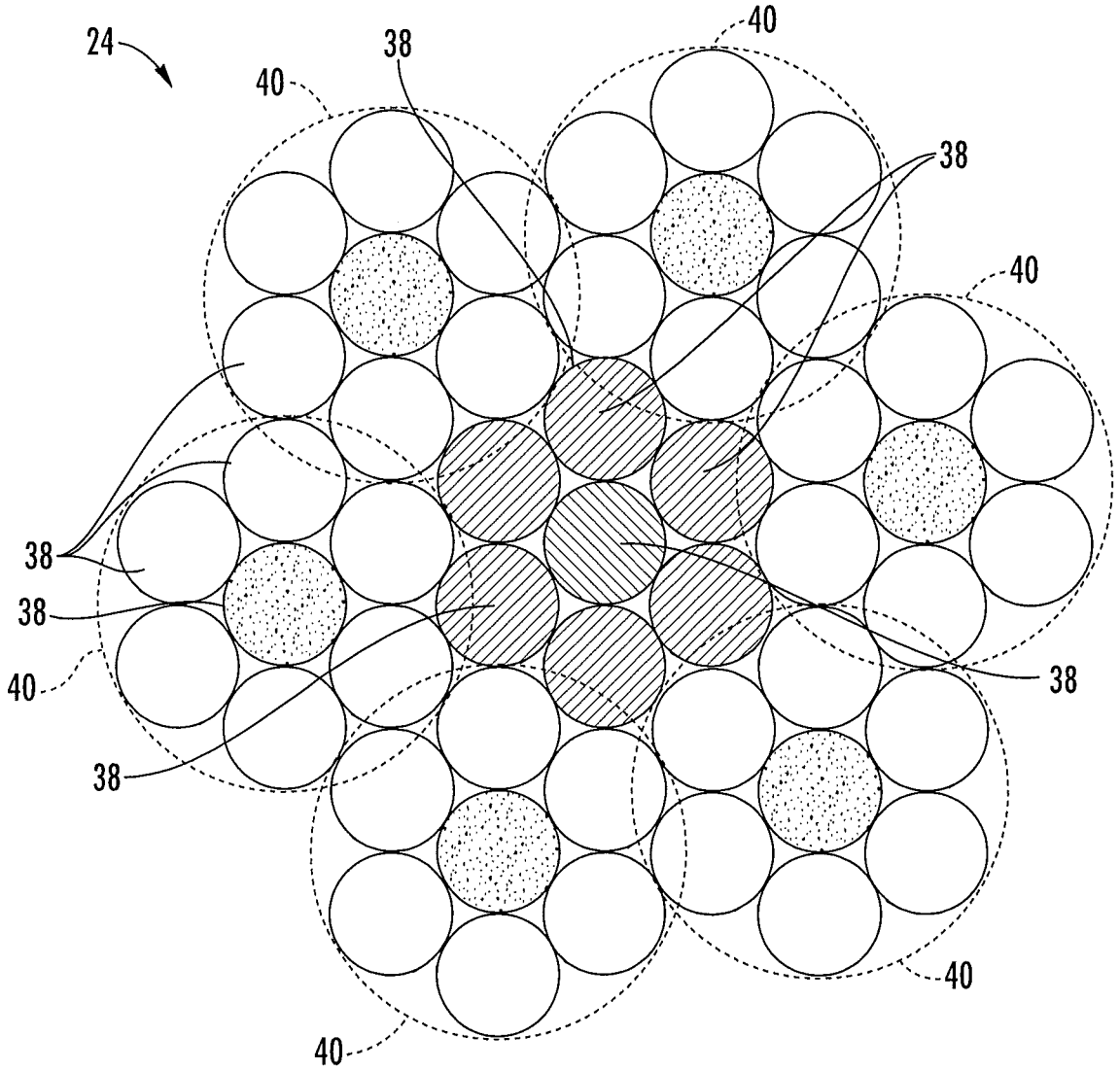
FIG. 3A is a cross-sectional view of an embodiment of a tension member of a belt.
Figure 3B:
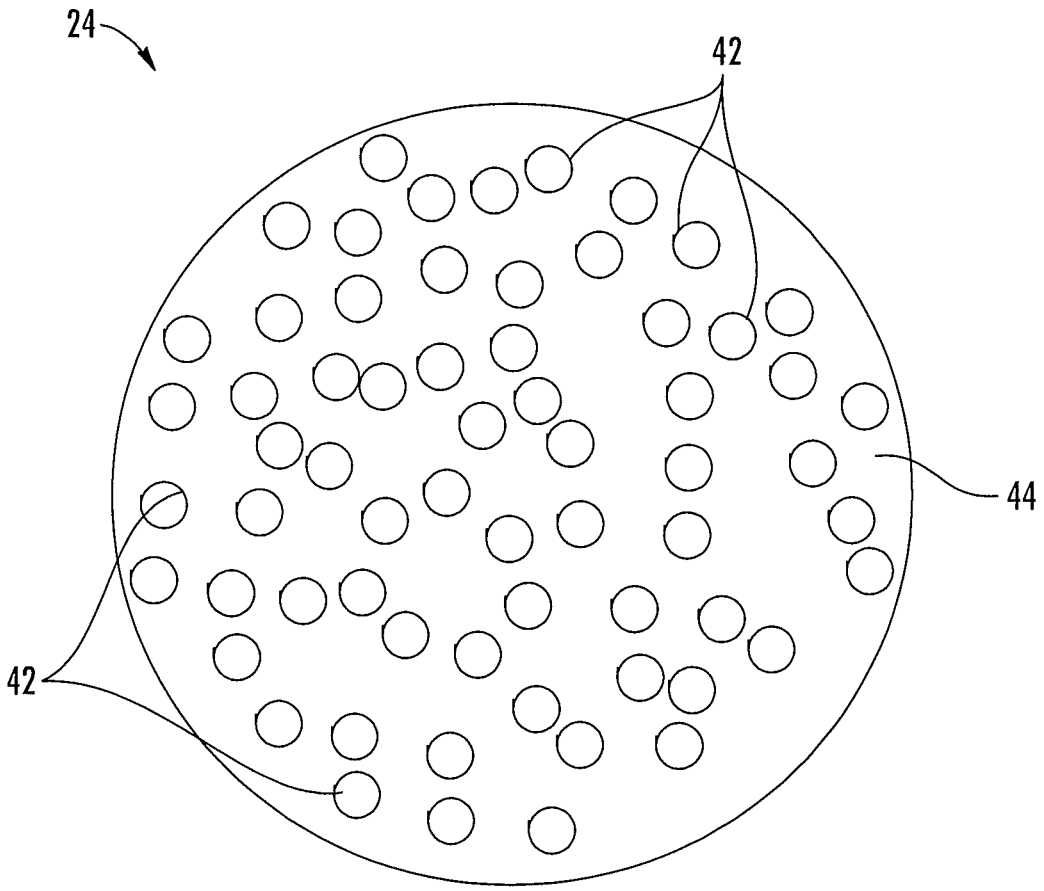
FIG. 3B is a cross-sectional view of another embodiment of a tension member of a belt.

Referring now to FIG. 3A, the tension member 24 may be a plurality of wires 38, for example, steel wires 38, which in some embodiments are formed into one or more strands 40. In other embodiments, such as shown in FIG. 3B, the tension member 24 may include a plurality of fibers 42, such as carbon fiber, glass fiber aramid fiber, or their combination, disposed in a matrix material 44. Materials such as polyurethane, vinylester, or epoxy may be utilized as the matrix material. While a circular cross-sectional tension member geometry is illustrated in the embodiment of FIG. 3B, other embodiments may include different tension member cross-sectional geometries, such as rectangular or ellipsoidal. While the cross-sectional geometries of the tension members 24 in FIG. 2 are shown as identical, in other embodiment the tension members cross-sectional geometries may differ from one another.

Figure 4A:
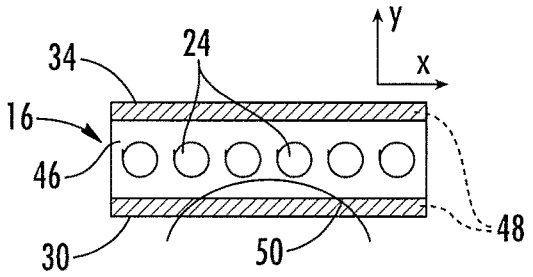
FIG. 4A is a cross-sectional view of an embodiment of a belt having one or more of a fluorescent, absorbing, or reflecting layer at an outside surface of the belt.
Figure 4B:
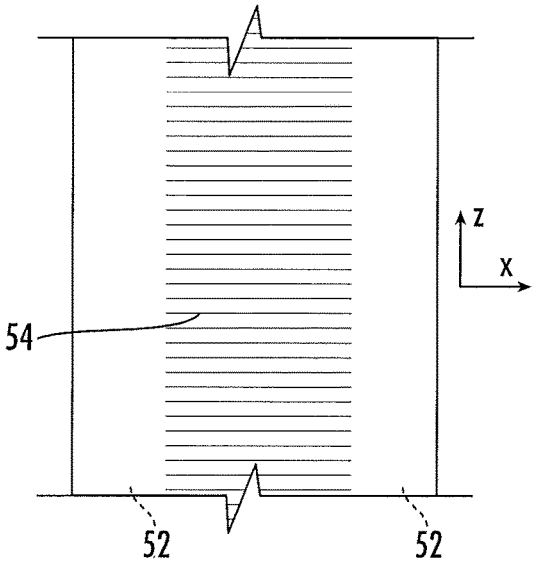
FIG. 4B is a plan view of a contact surface of a belt of FIG. 4A.

To reliably monitor wear of the jacket material 28, the jacket material 28 includes at least two separate polymers, with one of the polymers including fluorescent or absorbing or reflecting ingredients. These latter ingredients upon exposure to a appropriate light source, which could be in a ultra-violet, visible or other part of the electromagnetic radiation (EM) spectrum, fluoresce back at or absorb or/and reflect characteristic frequency or frequencies of the light spectrum. Typically, but not necessarily, ingredients are chosen to fluoresce or absorb or/and reflect in the visible part of the EM spectrum. Therefore, upon wear and under the proper light, the appearance of the fluorescent or absorbing or reflecting ingredients will indicate the level of wear of the belt. In one embodiment, shown in FIGS. 4A and 4B, the jacket material 28 includes an inner portion 46 formed from a first polymer and an outer portion 48 formed of a second polymer. The outer portion 48 defines the outer surface of the belt 16 at the traction side 30 and the back side 34. In the embodiment of FIGS. 4A and 4B, the second polymer of the outer portion 48 includes a fluorescent or absorbing or reflecting material, while the first polymer of the inner portion 46 is absent such a fluorescent or absorbing or reflecting material. In this embodiment, when the belt 16 wears, as indicated by wear line 50, first areas 52 of the belt 16 that exhibit fluorescence or absorbance or reflection under inspection are those that are not excessively worn, while second areas 54 that do not exhibit fluorescence or absorbance or reflection are those that are worn beyond a thickness of the outer portion 48.

Examples of fluorescent ingredients or materials utilized in the belt 16 are those that absorb ultraviolet (UV) light and that fluoresce in the visible spectrum and include, but or not limited to: anthra-thioxanthene, thioxanthene benzanthrone and anthraquinone series-based chemistries, known under the trade names Solvent Orange 63, Fluorescent Red GG, or Macolox Fluorescent Red GG; xanthene, benzothioxanthene-dicarboximide, and aminoketones series-based chemistries, known under the trade names Solvent Yellow 98, Fluorescent Yellow 3GF, Hostasol Yellow 3G, Solvent Fluorescent Yellow 3G, Rosaplast Yellow FSG, Keyplast Fluorescent Yellow 3R, Radglo CFS-6-03 Red, or Solvent Red 49; coumarin, coumarin 480, hydroxycourmarin, and glycidyl-oxycoumarin; benzopyran-based chemistry, know under the trade name Radglo CFS-6-02 Red, and solvent Red 196; azomethine-base chemistry, known under the trade name Radglo VSF-0-01; naphthalimide and perylene-based chemistries, know under the trade name Radglo CFS-0-01 Yellow or Solvent Yellow 43, Radglo CFS-0-05 or Solvent Green 5; and various UV fluorescent thermoset resin pigments.

Figure 5A:
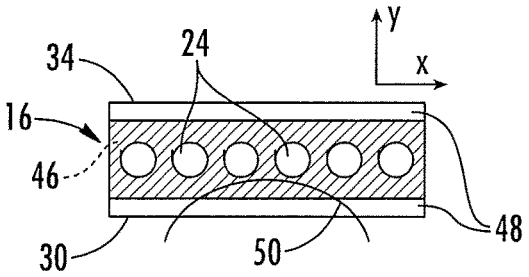
FIG. 5A is a cross-sectional view of an embodiment of a belt having one or more of a fluorescent, absorbing, or reflecting layer at an interior of the belt.
Figure 5B:
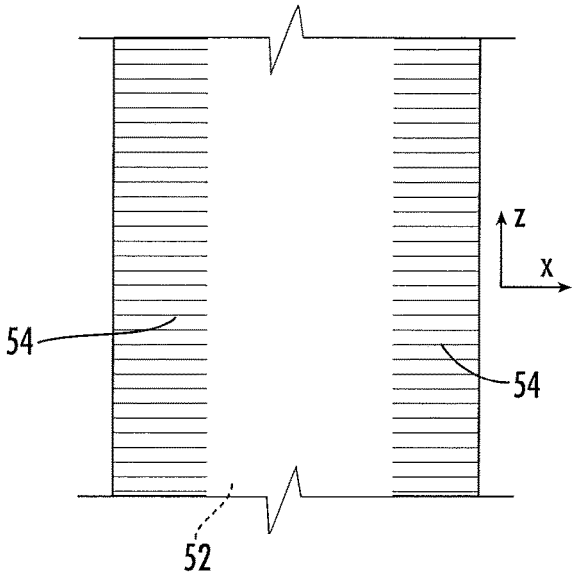
FIG. 5B is a plan view of a contact surface of a belt of FIG. 5A.

In another embodiment, shown in FIGS. 5A and 5B, the first polymer of the inner portion 46 includes a fluorescent or absorbing or reflecting material or ingredient, while the second polymer of the outer portion 48 is absent the fluorescent or absorbing or reflecting material or ingredient. As such, when the belt 16 wears as indicated by wear line 50, as shown in FIG. 5B first areas 52 of the belt 16 that exhibit fluorescence or absorbance or reflection under inspection are those that are worn beyond a thickness of the outer portion 48, while second areas 54 that do not exhibit fluorescence or absorbance or reflection are those that are not worn beyond a thickness of the outer portion 48.

Figure 6A:
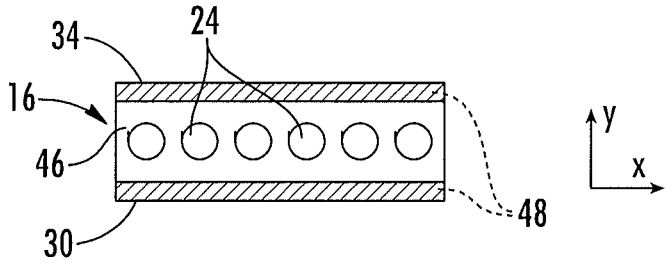
FIG. 6A-6F illustrate cross-sectional views of exemplary embodiments of belts having one or more of a fluorescent, absorbing, or reflecting layer.
Figure 6B:
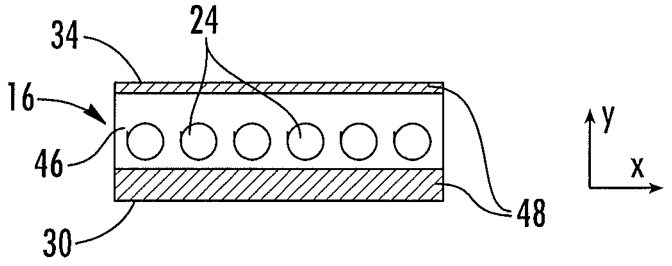
Figure 6C:
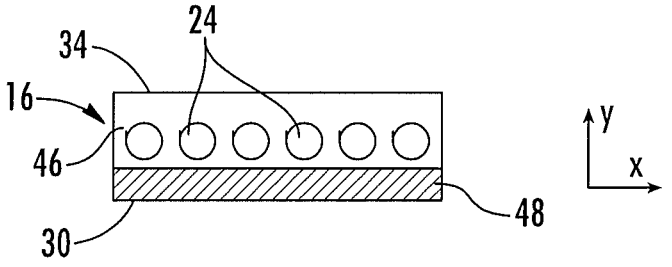

Variations of such construction are illustrated in FIGS. 6A-6F. In FIG. 6A, the polymer of the outer portion 48 includes the fluorescent or absorbing or reflecting material and is applied at the traction side 30 and the back side 34 symmetrically. Alternatively, as shown in FIG. 6B, the polymer of the outer portion 48 that includes the fluorescent or absorbing or reflecting material is asymmetrically applied at the traction side 30 and the back side 34, due to differing wear requirements of the traction side 30 back side 34. Further, in embodiments such as shown in FIG. 6C, the polymer of the outer portion 48 that includes the fluorescent or absorbing or reflecting material is applied at only one side of the belt 16 on which inspection of belt wear is to be evaluated, such as, for example, the traction side 30.

Figure 6D:
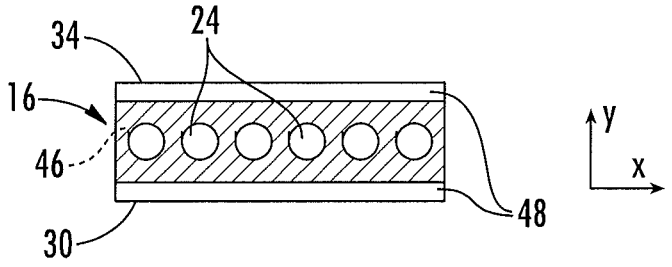
Figure 6E:
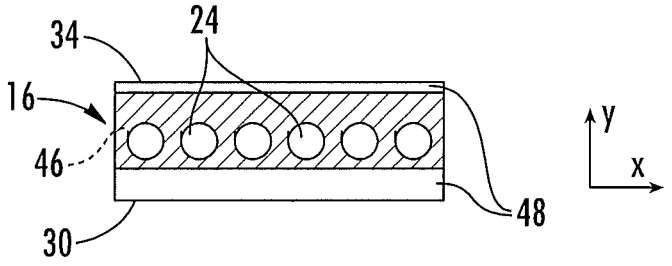
Figure 6F:
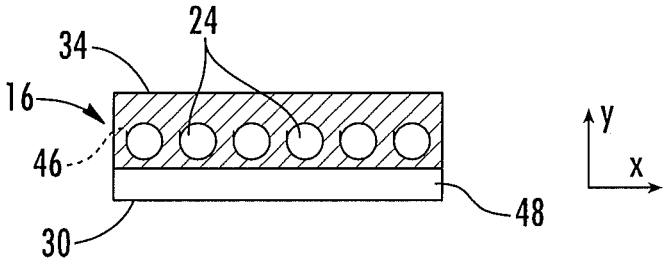

Additionally, in the embodiments of FIG. 6D-6F, the polymer of inner portion 46 includes the fluorescent or absorbing or reflecting material. In the embodiment of FIG. 6D, the polymer of the outer portion 48 is applied at the traction side 30 and the back side 34 symmetrically. Alternatively, as shown in FIG. 6E, the polymer of the outer portion 48 is applied asymmetrically at the traction side 30 and the back side 34, due to differing wear requirements of the traction side 30 back side 34. Further, in embodiments such as shown in FIG. 6F, the polymer of the outer portion 48 is applied at only one side of the belt 16 on which inspection of belt wear is to be evaluated, such as, for example, the traction side 30.

Figure 7A:
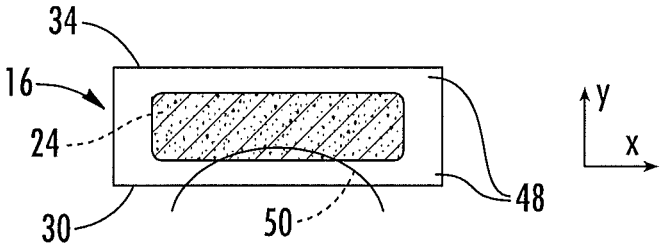
FIG. 7A is a cross-sectional view of an embodiment of a belt having a composite tension member with one or more of a fluorescent, absorbing, or reflecting material disposed in a matrix material.
Figure 7B:
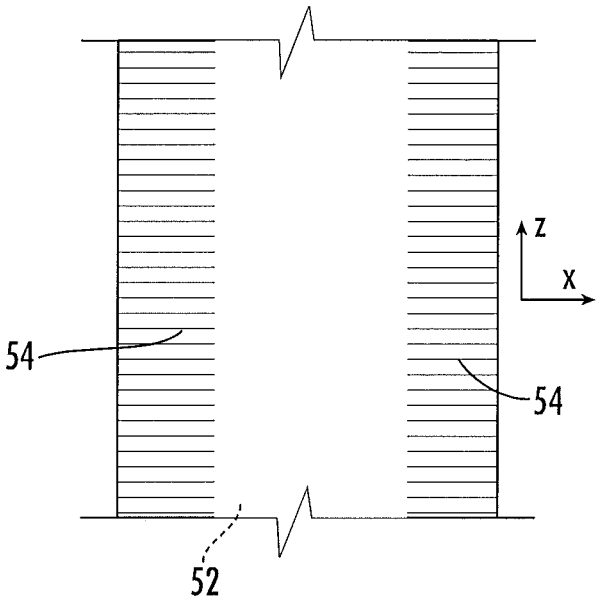
FIG. 7B is a plan view of a contact surface of a belt of FIG. 7A.

In another embodiment of a belt 16, such as those with a tension member 24 comprising a plurality of fibers 42 suspended in a matrix material 44, the matrix material 44 includes fluorescent or absorbing or reflecting materials, such as shown in FIGS. 7A and 7B. When the belt 16 wears as indicated by wear line 50, as shown in FIG. 7B first areas 52 of the belt 16 that exhibit fluorescence or absorbance or reflection under inspection are those that are worn beyond a thickness of the jacket material 28, exposing the matrix material 44 of the tension member. Second areas 54 that do not exhibit fluorescence or absorbance or reflection are those that are not worn beyond a thickness of the jacket material 28.

Figure 8A:
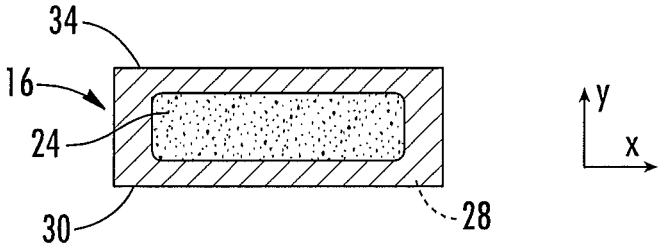
FIGS. 8A-8C illustrate exemplary embodiments of belts having composite tension members and one or more of fluorescent, absorbing, or reflecting materials.
Figure 8B:
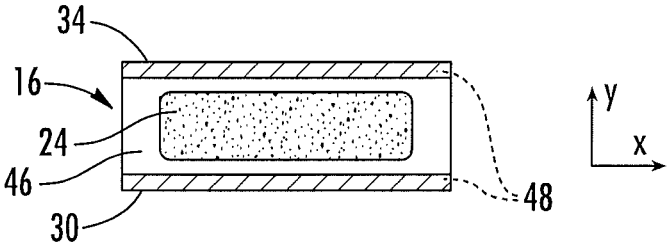
Figure 8C:
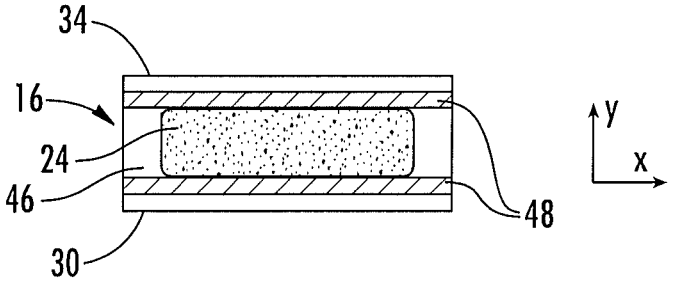

In FIGS. 8A-8C, variations of the construction are illustrated. In the embodiment of FIG. 8B, the matrix material 44 is absent a fluorescent or absorbing or reflecting material, while the jacket material 28 includes a fluorescent or absorbing or reflecting material. Referring to FIG. 8B, the jacket material includes a first portion 46 and a second portion 48, with the second portion 48 including the fluorescent or absorbing or reflecting material disposed symmetrically at the traction side 30 and the back side 34. In other embodiments, the second portion 48 is asymmetrically disposed at the traction side 30 and the back side 34. In other embodiments, the second portion 48 is disposed only at the traction side 30. In the embodiment of FIG. 8C, the second portion 48 including the fluorescent or absorbing or reflecting material is a distinct layer embedded below the traction side 30 and the back side 34. In other embodiments, only one second portion 48 is disposed at one side close to the traction side 30.

Figure 9:
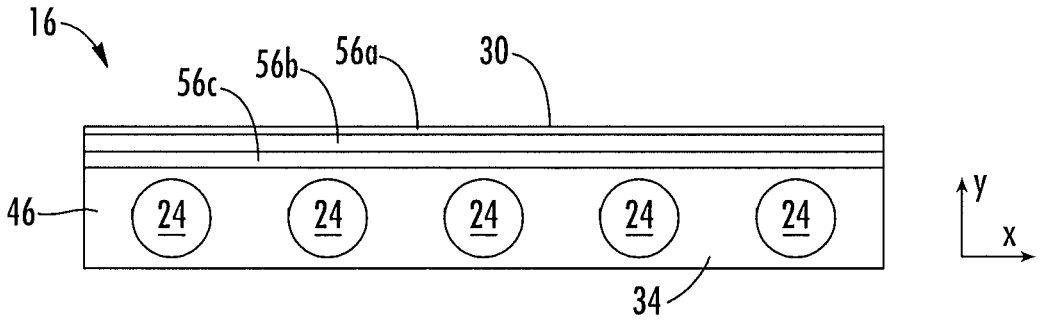
FIG. 9 illustrates an embodiment of a belt having multiple different fluorescent, absorbing, or reflecting material layers.

Referring now to FIG. 9, a belt 16 may include multiple layers 56 containing fluorescent or absorbing or reflecting material arranged in a stack. The multiple layers 56 may have fluorescent or absorbing or reflecting materials of different colors or different intensity (e.g., different volume fraction of fluorescent ingredients), with the indication of a particular color upon inspection indicating a particular depth of wear of the belt 16. For example, a first layer 56*a* may have a green fluorescent or absorbing or reflecting material therein, a second layer 56*b* may have a yellow fluorescent or absorbing or reflecting material therein and a third layer 56*c* may have a red fluorescent or absorbing or reflecting material therein. Similarly with layers 56 of different fluorescent or absorbing or reflecting intensity, for example, the deepest layer 56*c* may have higher volume fraction of fluorescent or absorbing or reflecting materials with much brighter reflection, the second layer 56*b* may have lower content of fluorescent or absorbing or reflecting materials with less intensive light reflection, and so on.

Figure 10A:
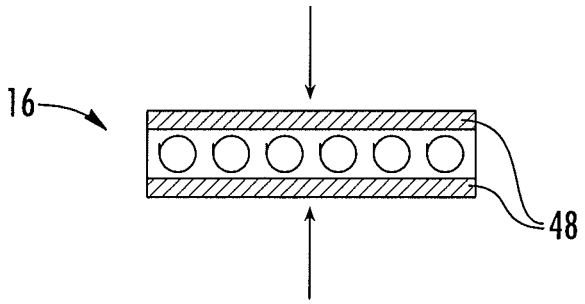
FIGS. 10A-10D illustrate exemplary embodiments of wear detection systems.

The belt 16 configurations described herein are inspected for wear by various methods and apparatus, examples of which will be described below. In some embodiments, such as shown in FIG. 10A, the belt 16 is inspected manually, or visually, by a technician to evaluate the appearance of the belt 16 upon illumination with the proper light source for indications of fluorescence or absorbance or reflection or absence of the above from the respective polymer layers discussed in the embodiments, to evaluate the wear of the belt 16. The belt appearance changes are associated with either appearance or disappearance of fluorescence or absorbance or reflection from a belt zone due to wear in the respective belt zones and areas.

Figure 10B:
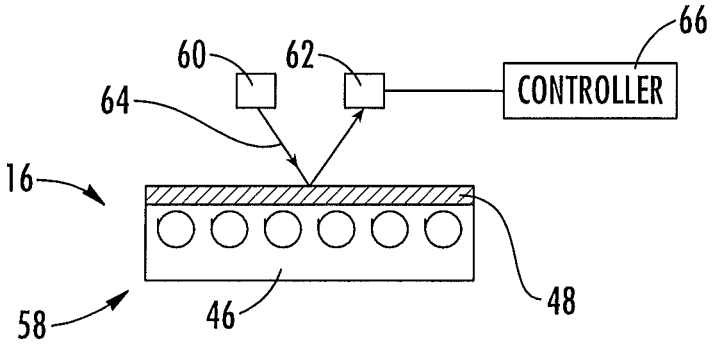

In another embodiment, such as shown in FIG. 10B, the elevator system 10 includes a wear detection system 58 located in the hoistway 12. The wear detection system 58 includes a light emitter 60 and a detector 62. The light emitter 60 directs light 64 at the belt 16, with any fluorescence or absorbance or reflection of the belt 16 detected by the detector 62. In some embodiments, the detector 62 transmits an output signal indicative of the detected fluorescence or absorbance or reflection to a controller 66, which evaluates the output signal compared to a wear threshold, and in some embodiments transmits an alert based on the result of the comparison. In other embodiments, this detection may be done remotely. In another embodiment the alert includes 2-dimensional (belt length and width) spatial resolution of the worn area(s) in addition to the belt wear depth information at each location, providing information to service personnel that results in reduced downtime due to maintenance and repairs.

Figure 10C:
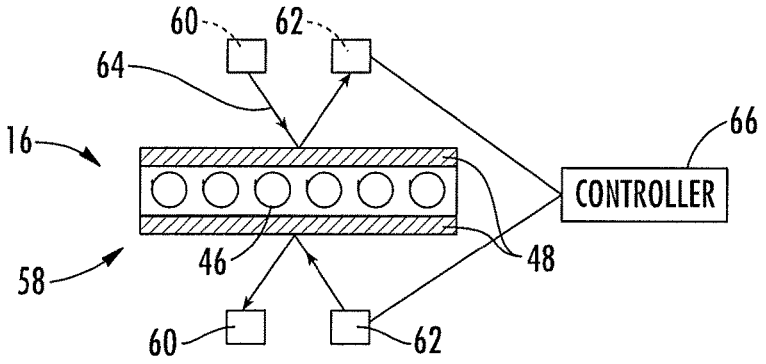
Figure 10D:
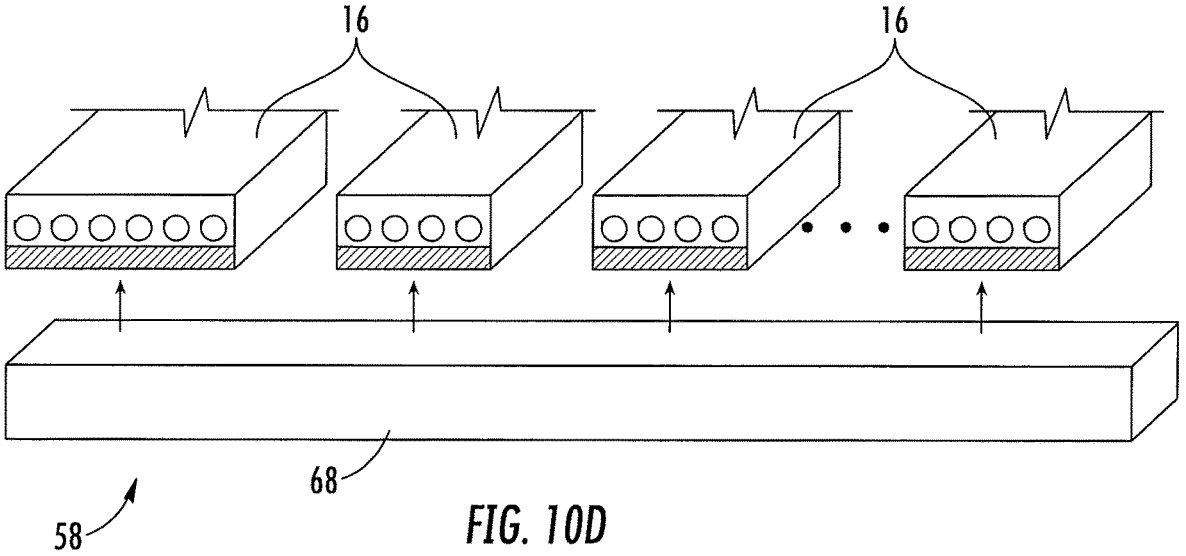

In the embodiment of FIG. 10B, the detection system 58 evaluates a single side of the belt 16, while in the embodiment of FIG. 10C the detection system 58 is configured to evaluate two sides of the belt 16. In some elevator systems 10 with multiple belts 16, the detection system 58 includes a multi-sensor rack 68 via which two or more belts 16 of the elevator system 10 may be simultaneously evaluated for wear as shown in FIG. 10D. In another embodiment two multi-sensor rack detection systems 68, facing the opposing traction sides of the belts, are configured to evaluate the wear of both sides of the multiple belt configuration 16 simultaneously.

Figure 11A:
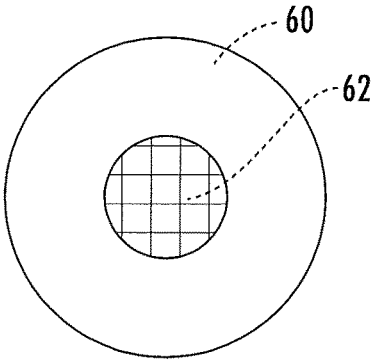
FIGS. 11A and 11B illustrate exemplary embodiments of integrated emitters and detectors for wear detection systems.
Figure 11B:
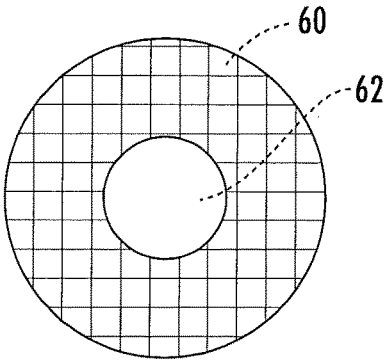

In some embodiments, shown in FIGS. 11A and 11B, the light emitter 60 and the detector 62 are combined into a single component. For example, in FIG. 11A, the combined emitter/detector is circular, with the detector 62 surrounding the light emitter 60. In another example, shown in FIG. 11B, the light emitter 60 surrounds the detector 62. It is to be appreciated that the embodiments illustrated in FIGS. 11A and 11B are merely exemplary, and that other combined emitter/detector configurations, shapes and geometries are contemplated within the scope of the present disclosure.

Figure 12:
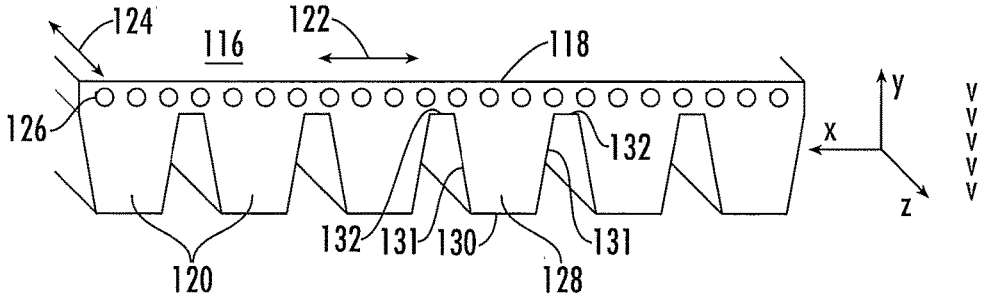
FIG. 12 is a cross-sectional view of an example of a power transmission belt.

While the belt 16 configurations above are presented in the context of an elevator system 10, the present disclosure may be readily applied to other types of belts for lifting, suspending, moving, or power transmission, examples of which include conveyor belts, escalator belts, power transmission belts, timing belts, or the like. For example, an example of a power transmission belt 116 is shown in FIG. 12. The power transmission belt 116 includes a back side 118 and a plurality of belt ribs 120 extending from a side opposite to the back side 118. The plurality of belt ribs 120 are arrayed across a belt width 122 and extend along a belt length 124. Each rib may have a tip side 130, slope sides 131, and bottom sides 132. The ribs may also have more complex cross-sectional geometries and designs. A plurality of tension members 126 are enclosed in the belt 116 and extend along the belt length 124. The tension members 126 are enclosed in jacket material 128. The jacket 128 includes a first jacket portion 128A having a first polymer construction, and a second portion 128B formed from a second material configuration including a fluorescent, reflective or absorbent material.

Figure 12A:
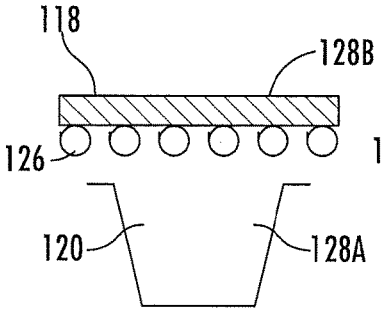
FIGS. 12A-12I are partial cross-sectional views of examples of the belt of FIG. 12.
Figure 12B:
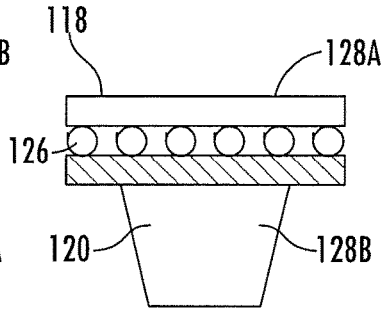
Figure 12C:
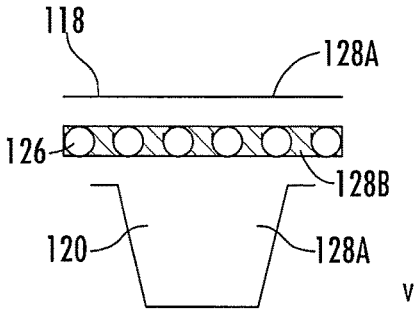

Referring now to FIGS. 12A-12I, views of exemplary configurations of belt 116 are illustrated. In FIG. 12A, the second polymer portion 128B is disposed at the back side 118, with the remaining jacket formed from the first polymer portion 128A. In the embodiment of FIG. 12B, the first polymer portion 128A is disposed at the back side 118 and surrounding the tension members 126, while the second polymer portion 128B is disposed at the belt ribs 120. In the embodiment of FIG. 12C, the second polymer portion 128B surrounds the tension members 126, while the remaining portions of the jacket are formed from the first polymer portion 128A.

Figure 12D:
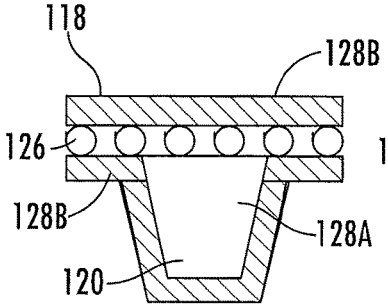
Figure 12E:
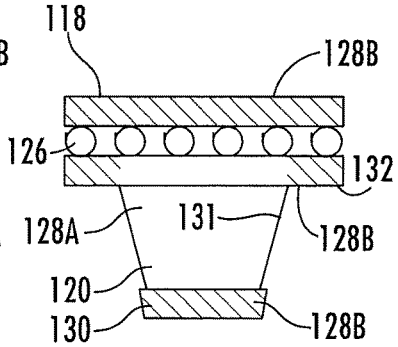
Figure 12F:
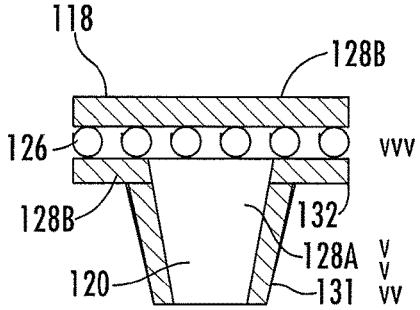
Figure 12G:
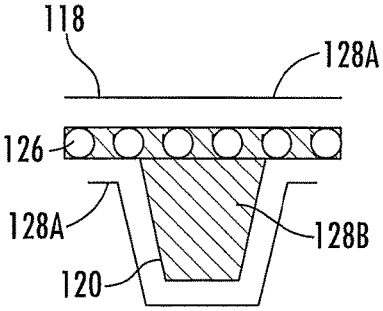
Figure 12H:
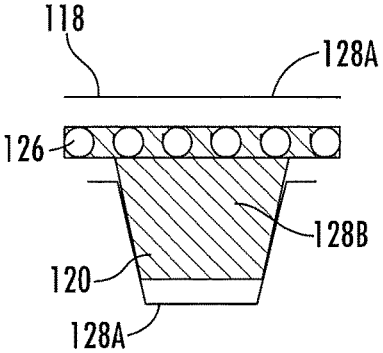
Figure 12I:
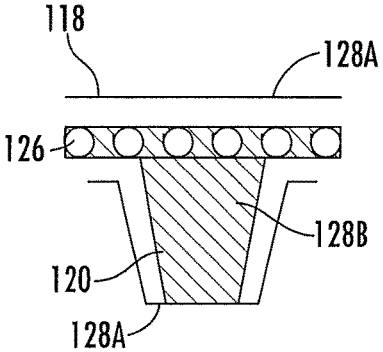

Referring to the embodiment of FIG. 12D, the back side 118 and the entire exterior of the belt rib 120 may be formed from the second polymer portion 128B, while the remaining jacket, including an interior of the belt rib 120 is formed from the first polymer portion 128A. In the embodiment of FIG. 12E, both the back side 118 and a partial exterior of the belt rib 120, including, for example, of a rib tip side 130 and rib bottom sides 132, are formed from the second polymer portion 128B. In FIG. 12F, the back side 118 and a partial exterior of the belt rib 120, including, for example, of rib bottom sides 132 and rib slope sides 131, are formed from the second polymer portion. FIGS. 12G, 12H, and 12I are essentially opposites of the configurations of FIGS. 12D, 12E, and 12F, respectively, with the second polymer portions 128B represented by cross-hatching in the FIGs.

Figure 13:
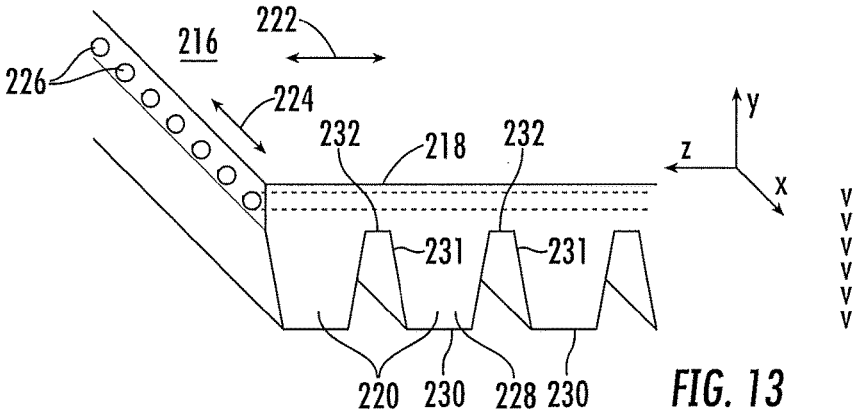
FIG. 13 is a cross-sectional view of an example of a timing belt.

In another example, a timing belt 216 is shown in FIG. 13. The power transmission belt 216 includes a back side 218 and a plurality of belt ribs 220 extending from the back side 218. The plurality of belt ribs 220 are arrayed along a belt width 222 and extend across a belt length 224. Each rib may have a tip side 230, slope sides 231, and rib bottom sides 232. The ribs may also have more complex cross-sectional geometries and designs. A plurality of tension members 226 are enclosed in the belt 216 and extend along the belt length 224. The tension members 226 are enclosed in jacket material 228. The jacket 228 includes a first jacket portion 228A having a first polymer construction, and a second portion 228B formed from a second material configuration including a fluorescent, reflective or absorbent material.

Figure 13A:
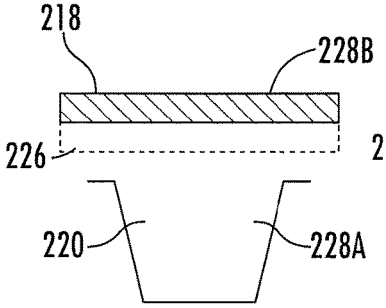
FIGS. 13A-13I are partial cross-sectional views of examples of the belt of FIG. 13.
Figure 13B:
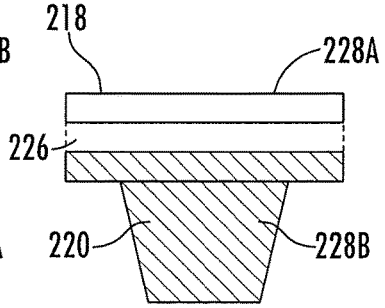
Figure 13C:
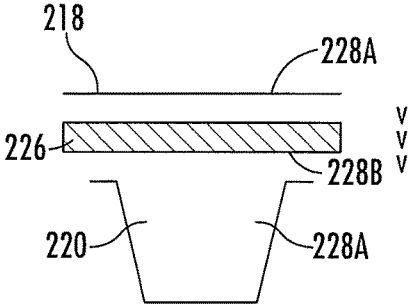

Referring now to FIGS. 13A-13I, views of exemplary configurations of belt 216 are illustrated. In FIG. 13A, the second polymer portion 228B is disposed at the back side 218, with the remaining jacket formed from the first polymer portion 228A. In the embodiment of FIG. 13B, the first polymer portion 228A is disposed at the back side 218 and surrounding the tension members 226, while the second polymer portion 228B is disposed at the belt ribs 220. In the embodiment of FIG. 13C, the second polymer portion 228B surrounds the tension members 226, while the remaining portions of the jacket are formed from the first polymer portion 228A.

Figure 13D:
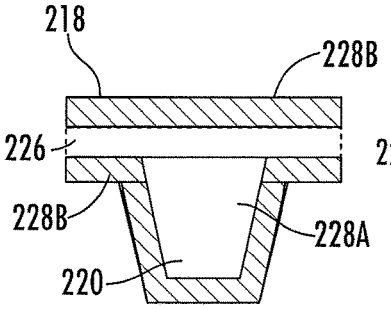
Figure 13E:
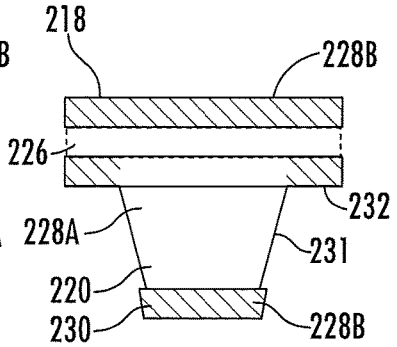
Figure 13F:
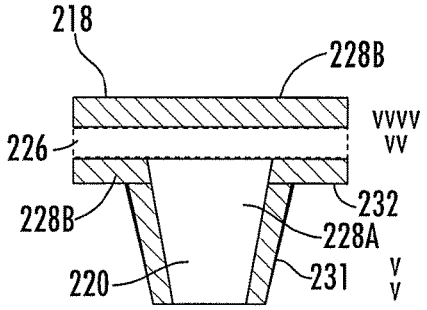
Figure 13G:
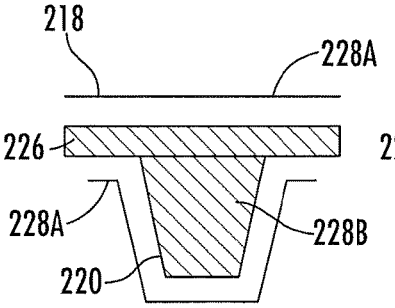
Figure 13H:
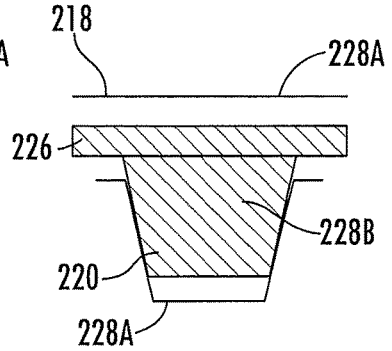
Figure 13I:
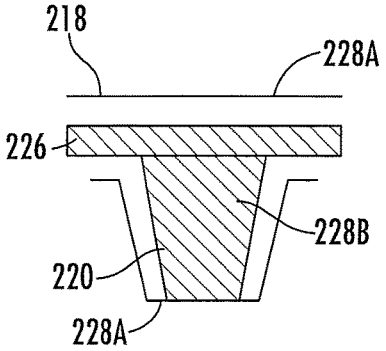
Figure 14:
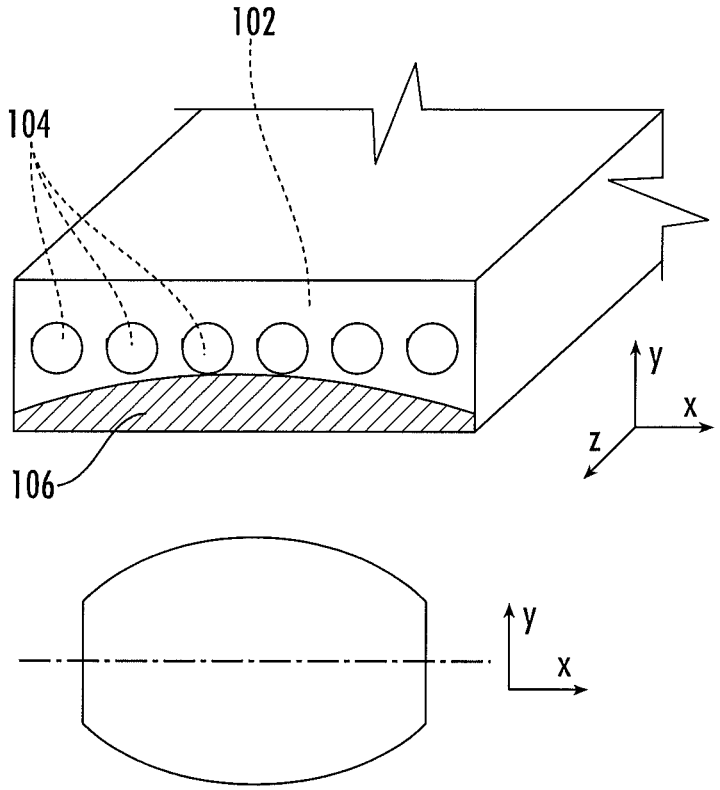
FIG. 14 illustrates an example of a wear pattern of a typical elevator belt.

Referring to the embodiment of FIG. 13D, the back side 218 and the entire exterior of the belt rib 220 may be formed from the second polymer portion 228B, while the remaining jacket, including an interior of the belt rib 220 is formed from the first polymer portion 228A. In the embodiment of FIG. 13E, both the back side 218 and a partial exterior of rib 220, including, for example, of rib tip side 230 and rib bottom sides 232, are formed from the second polymer portion 228B. In FIG. 13F, the back side 218 and a partial exterior of rib 220, including, for example, of rib bottom sides 232 and rib slope sides 231 are formed from the second polymer portion. FIGS. 13G, 13H, and 13I are essentially opposites of the configurations of FIGS. 13D, 13E, and 13F, respectively, with the second polymer portions 228B represented by cross-hatching in the FIGs.

The embodiments disclosed herein provide reliable, accurate, low-cost systems and methods for evaluating wear of belts 16 of elevator systems 16. Accurately determining a level of wear of a belt 16 prevents premature replacement of elevator belts 16 that are not sufficiently worn to actually warrant their replacement, and prevents overworn belts from remaining in service.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A belt, comprising:
one or more tension members extending along a length of the belt;
a jacket at least partially enclosing the plurality of tension members; and
one or more layers of one or more of a fluorescent material disposed in the belt such that when subjected to a light source, an indication of fluorescence of the one or more layers of fluorescent materials is indicative of a wear condition of the belt.

2. The belt of claim 1, wherein the one or more layers of fluorescent material are disposed at an outer surface of the jacket.

3. The belt of claim 1, wherein the one or more layers of fluorescent material are disposed in an interior of the jacket, between the jacket outer surface and the one or more tension members.

4. The belt of claim 1, wherein the one or more layers of fluorescent material are disposed at only one of a traction side or a back side of the belt.

5. The belt of claim 1, wherein the one or more layers of fluorescent material are disposed asymmetrically with respect to a belt thickness direction.

6. The belt of claim 1, wherein the one or more layers of fluorescent material are disposed one of continuously or discontinuously along a length or a width of the belt.

7. The belt of claim 1, wherein the one or more tension members are a plurality of tension members arrayed across a belt width, each tension member including a plurality of wires.

8. The belt of claim 1, wherein the one or more tension members comprises a plurality of fibers suspended in a polymer matrix material.

9. The belt of claim 8, wherein the polymer matrix material includes one or more fluorescent materials.

10. The belt of claim 1, wherein the light source is an ultraviolet light or visible or other light spectrum source.

11. A method of wear detection of a belt comprising:
emitting light from a light emitter toward a belt of an elevator system;
one or more materials of the elevator belt; and
detecting a pattern of the fluorescence of the elevator belt, wherein the pattern of fluorescence is indicative of a wear pattern of the belt.

12. The method of claim 11, wherein the light source is an ultraviolet (UV) light or visible light or other light spectrum source.

13. The method of claim 11, wherein the detecting the pattern of fluorescence is accomplished via a detector.

14. The method of claim 11, further comprising detecting the pattern of fluorescence at both a traction side and a back side of the belt.

15. An elevator system, comprising:
a hoistway;
an elevator car disposed in the hoistway;
an elevator belt operably connected to the elevator car to suspend and/or drive the elevator car along the hoistway, the elevator belt comprising:
one or more tension members extending along a length of the belt;

a jacket at least partially enclosing the plurality of tension members; and one or more layers of fluorescent materials disposed in the at least one belt; and a wear detection system disposed in the hoistway, comprising:

a light emitter to direct light at the elevator belt; and a detector configured to detect a pattern of the fluorescence, of the elevator belt, wherein the pattern of fluorescence is indicative of a wear pattern of the belt.

16. The elevator system of claim 15, wherein the emitter is configured to emit ultraviolet (UV) or visible or other light spectrum.

17. The elevator system of claim 15, wherein the detector is unitary with the emitter.

18. The elevator system of claim 15, wherein the one or more layers of fluorescent material are disposed at an outer surface of the jacket.

19. The elevator system of claim 15, wherein the one or more layers of fluorescent material are disposed in an interior of the jacket, between the jacket outer surface and the one or more tension members.

20. The elevator system of claim 15, wherein the one or more tension members comprises a plurality of fibers suspended in a polymer matrix material.

* * * * *